US007234652B2

(12) United States Patent
Rodeman

(10) Patent No.: US 7,234,652 B2
(45) Date of Patent: Jun. 26, 2007

(54) DOUBLE CURVED SURFACE DEFLECTOR SYSTEM FOR ROTARY SPRINKLERS

(76) Inventor: Robert Rodeman, 3407 W. Dusty La., Benton City, WA (US) 99336

( * ) Notice: Subject to any disclaimer, the term of this patent is extended or adjusted under 35 U.S.C. 154(b) by 0 days.

(21) Appl. No.: 11/094,654

(22) Filed: Mar. 30, 2005

(65) Prior Publication Data

US 2006/0226261 A1 Oct. 12, 2006

(51) Int. Cl.
*B05B 3/08* (2006.01)

(52) U.S. Cl. ..... 239/231; 239/201; 239/232; 239/246; 239/264; 239/505; 239/513

(58) Field of Classification Search ..... 239/230, 239/231, 232, 233, 246, 201, 468, 505, 513, 239/521, 589.1, 264
See application file for complete search history.

(56) References Cited

U.S. PATENT DOCUMENTS

| | | | | |
|---|---|---|---|---|
| 2,223,441 | A | 12/1940 | Coles | |
| 2,625,411 | A | 1/1953 | Unger | |
| 2,674,492 | A | 4/1954 | Sciuto | |
| 2,708,598 | A * | 5/1955 | Stary | 239/231 |
| 2,792,256 | A | 5/1957 | Sinex | |
| 3,019,992 | A | 2/1962 | Zecchinato | |
| 3,408,009 | A | 10/1968 | Friedmann et al. | |
| 3,871,582 | A * | 3/1975 | Biddle | 239/233 |
| 4,164,324 | A | 8/1979 | Bruninga | |
| 4,182,494 | A | 1/1980 | Wichman et al. | |
| 4,330,087 | A | 5/1982 | Wood et al. | |
| 4,457,470 | A | 7/1984 | Hauger et al. | |
| 5,031,835 | A | 7/1991 | Rojas | |
| 5,671,885 | A * | 9/1997 | Davisson | 239/222.17 |
| 5,769,322 | A | 6/1998 | Smith | |
| 5,992,760 | A | 11/1999 | Kearby | |
| 6,076,746 | A * | 6/2000 | Kantor et al. | 239/222.17 |
| 6,092,739 | A * | 7/2000 | Clearman et al. | 239/237 |
| 6,142,386 | A | 11/2000 | Spenser | |
| 6,155,493 | A | 12/2000 | Kearby et al. | |
| 6,254,014 | B1 * | 7/2001 | Clearman et al. | 239/222.15 |
| 6,264,118 | B1 * | 7/2001 | Kantor et al. | 239/222.17 |
| 6,478,237 | B2 | 11/2002 | Kearby et al. | |
| 2006/0060667 | A1 * | 3/2006 | Wang | 239/246 |

* cited by examiner

*Primary Examiner*—Steven J. Ganey
(74) *Attorney, Agent, or Firm*—Northwest Patent Law

(57) ABSTRACT

The present invention is a double curved surface deflector system for rotary sprinklers providing for a 360-degree rotation using both clockwise and counterclockwise movements. A spray coupler directs water in forward and rear directions. The forward direction is deflected by an inward facing deflector that directs the water across a curved surface projects the water in the reverse direction with an adjustable water elevator for extended lift. After the sprinkler head rotates until the selector hits an adjustable stop, the inward facing deflector then pivots the sprinkler head in the opposite direction for the remainder of the coverage.

7 Claims, 7 Drawing Sheets

DOUBLE CURVED SURFACE DEFLECTOR SYSTEM FOR ROTARY SPRINKLERS

FIELD OF THE INVENTION

The present invention relates to a sprinkler, specifically, a sprinkler that directs water radially outward, while turning alternately in either a clockwise or a counterclockwise direction.

BACKGROUND

U.S. Pat. No. 2,625,411 (hereinafter '411) describes a Sprinkler Rotating Spinner Drive Sand Seal. As illustrated in FIG. 3, of '411 the sprinkler head is a mechanism that would force the water over several rough surfaces causing a loss of head pressure. Also, the flow pattern is unidirectional through one nozzle. Although, the vertical pivot (106) of '411 directs the water path, the range of the directed water angle is limited.

U.S. Pat. No. 3,664,586 (hereinafter '586) describes a sprinkler head with limited rotational ability. In FIG. 6 the deflector (42) operates radially outward, in the present invention the deflector (34) operates radially inward. Patent '586 represents a unidirectional sprinkler as opposed to the present invention that is a bidirectional sprinkler.

The prior art does not teach a double curved surface nor does it teach the radiation of water with an inward deflector or adjustable elevator.

SUMMARY

A double curved surface deflector system for rotary sprinklers that has a liquid dispenser, selector, deflector, pivot arm, and a double curved surface having a clockwise directing curved surface and a counter-clockwise directing curved surface, wherein a liquid is dispensed from the dispenser across the deflector, a selected direction over a selected curved surface, to provide a spray of liquid. A method of sprinkling water onto a surface that moves a stream of water through a pair of friction reducing bearings, directs the water stream with a selector attached to a deflector positioned radially inward from a pivot arm, and curves the directed water stream over a curved surface in a clockwise or counter-clockwise direction as directed by the selector, and gathers the directed water stream with a middle and two outside grooves in an elevator table; and elevates the gathered stream of water with an elevator table by elevating the table to a desired angle with a set screw.

The double curved surface deflector system for rotary sprinklers is supported by a bearing system that reduces frictional forces and therefore increases the rotational efficiency of the sprinkler. The reduction of the frictional forces is accomplished by a pipe connector, a journal assembly attached to the pipe connector, a sprinkler shaft with two opposite holes, the sprinkler shaft inserted into a bottom coupler bearing with frictional reducing surfaces and a top coupler bearing with frictional reducing surfaces, a spray coupler having an anterior spray orifice and a posterior spray orifice, inserted over the bottom coupler bearing with frictional reducing surfaces, and the top coupler bearing with frictional reducing surfaces, the spray coupler inserted into a bottom housing plate having a spray coupler hole, a selector slot and a pivot arm hole, a deflector assembly attached to a selector and a pivot arm, the selector extending down through the selector slot between the arms of a top angle adjuster and the arms of a bottom angle adjuster, the top and bottom angle adjusters attached to the journal assembly, the pivot arm extending into the pivot arm hole. The spray coupler and the deflector assembly encased with two-side housing brackets having upper edges and lower edges attached to a double curved surface with a top edge and a bottom edge, the side housing brackets having elevator pivot holes, the bottom housing plate affixed to the bottom edge of the side housing brackets and the bottom edge of the double curved surface; and a top housing plate having a spray coupler hole and a pivot arm hole, the housing plate attached to the upper edge of the side housing brackets and the upper edge of the double curved surface.

DETAILED DESCRIPTION OF THE DRAWINGS

Figure 1:
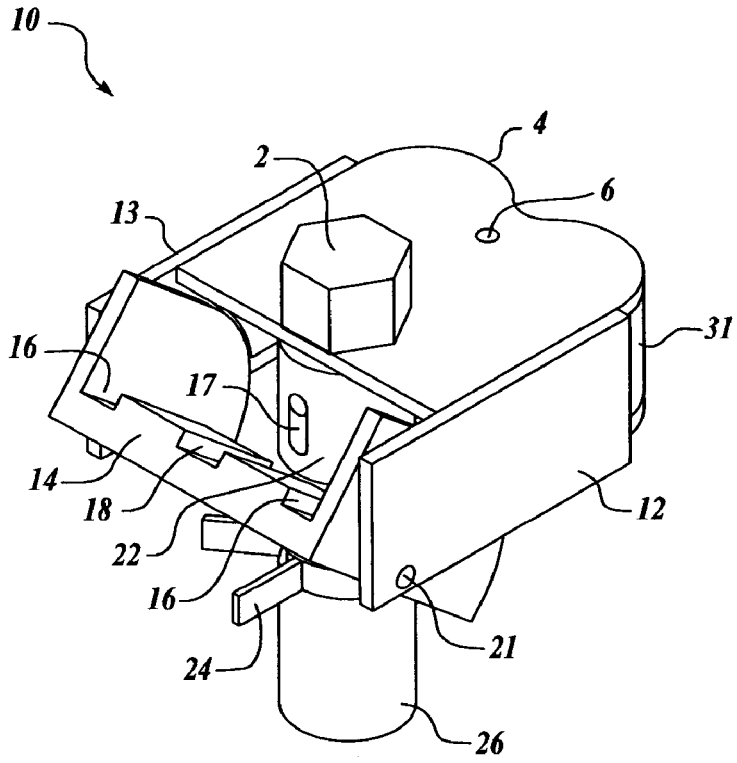
FIG. 1 is a downward view of the assembled double curved surface rotary sprinkler.

In FIG. 1 a top housing plate (4) and two side housing brackets (12) and (13) connect the double-curved surface (31). A pivot am (6) protrudes through the top housing plate (4). A threaded coupler cap (2) secures the top housing plate to the two housing side brackets (12) and (13) and is threaded onto the female threads of the journal assembly (22). The spray coupler (22) has a posterior spray orifice (17). Water or liquid from the posterior spray orifice (17) that is deflected upward by a middle elevator groove (18) cut into an elevator table (14) connected to the two side housing brackets (12) and (13) with elevator pins (21) and (opposing side pin not shown) extending from the elevator table (14) orthogonal into the two side housing brackets (12) and (13). The elevator table has two side elevator grooves (16) and a middle groove (18).

Figure 2:
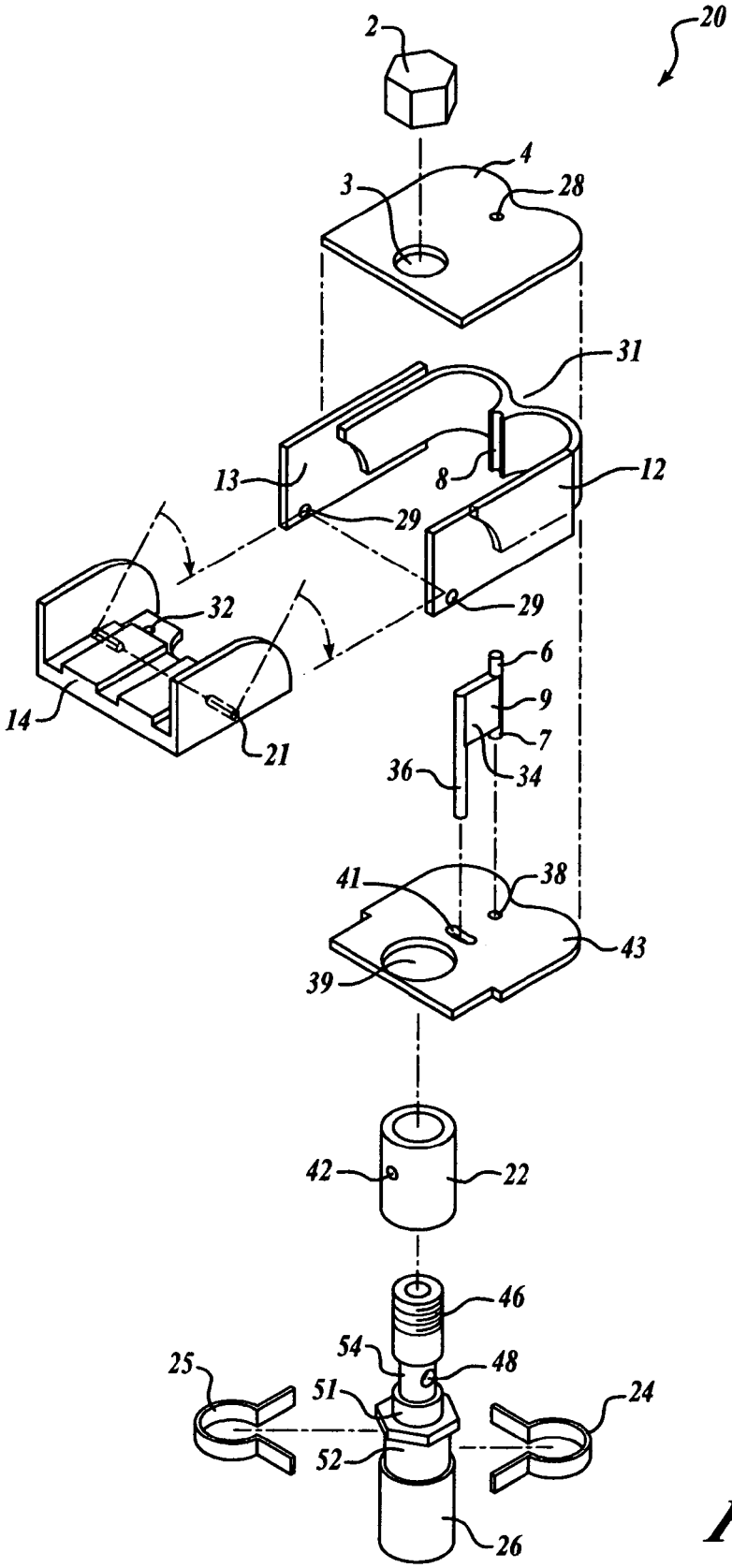
FIG. 2 is a side view exploding the parts of the curved surface sprinkler housing and coupler-bearing assembly.

FIG. 2 shows the exploded sprinkler housing and coupler-bearing assembly (20). A sprinkler housing (10) rests upon a pipe connector (26) with a top (25) and a bottom angle adjuster (24), these angle adjusters are used to direct the rotation of the sprinkler head. A water source (not shown) is threaded to a coupler (not shown) connected to an elbow (not shown) that is attached to a pipe connector (26).

The pipe connector (26) is attached to a journal assembly (52). The journal assembly (52) connects to a sprinkler shaft (54) with a top coupler bearing (46) and a bottom coupler bearing (51). The sprinkler shaft (54) has at least two outlets of hole (48) and (49) FIG. 3A to allow water to pass to an posterior spray orifice (42) and a posterior spray orifice (58) of a spray coupler (22) FIG. 3A. The top angle adjuster (25)

having a spring tension and a bottom adjuster (24) also with a spring tension, are clipped onto the outer surface of the journal assembly (52).

One of the features of the present invention is the arrangement of the bottom coupler bearing (51) and the top coupler bearing (46) along with the sprinkler shalt (54) minimizing the frictional forces that work against the sprinkler moving by having negligible pressure related frictional forces on the bearing seal surfaces. This alleviates the sprinkler from the requirement of overcoming a large pressure related static force in order to rotate the sprinkler. Also, the opposing arrangement of the posterior (42) and anterior spray orifice (58) on the spray couple (22) allows the force exerted by the water exiting in one orifice (posterior (42) or anterior (58)) to be offset by the opposing orifice.

A double curved surface inner midpoint pivot arm slot (8) is shaped to accommodate, support or stabilize the pivot arm and to allow the deflector (34) to be rotated inward from the double curved surface at a range of angles to deflect the stream of water.

A bottom housing plate (43) is seated onto a spray coupler (22) with a bottom housing plate coupler aperture (39). The bottom housing plate (43) also has a selector slot (41) and a pivot armhole (38). A pivot arm bottom end (7) extends into the pivot armhole (38) with enough tolerance to rotate freely. The pivot arm top end (6) and bottom end (7) are attached to a deflector (34). The deflector (34) extends through a selector slot (41) and makes contact with either an arm of the bottom angle adjuster (24) or an arm of the top angle adjuster (25) depending upon the degree of angle rotation set by the operator with the arms of the bottom angle adjustor (24) and the arms of the top angle adjuster (25).

Figure 3A:
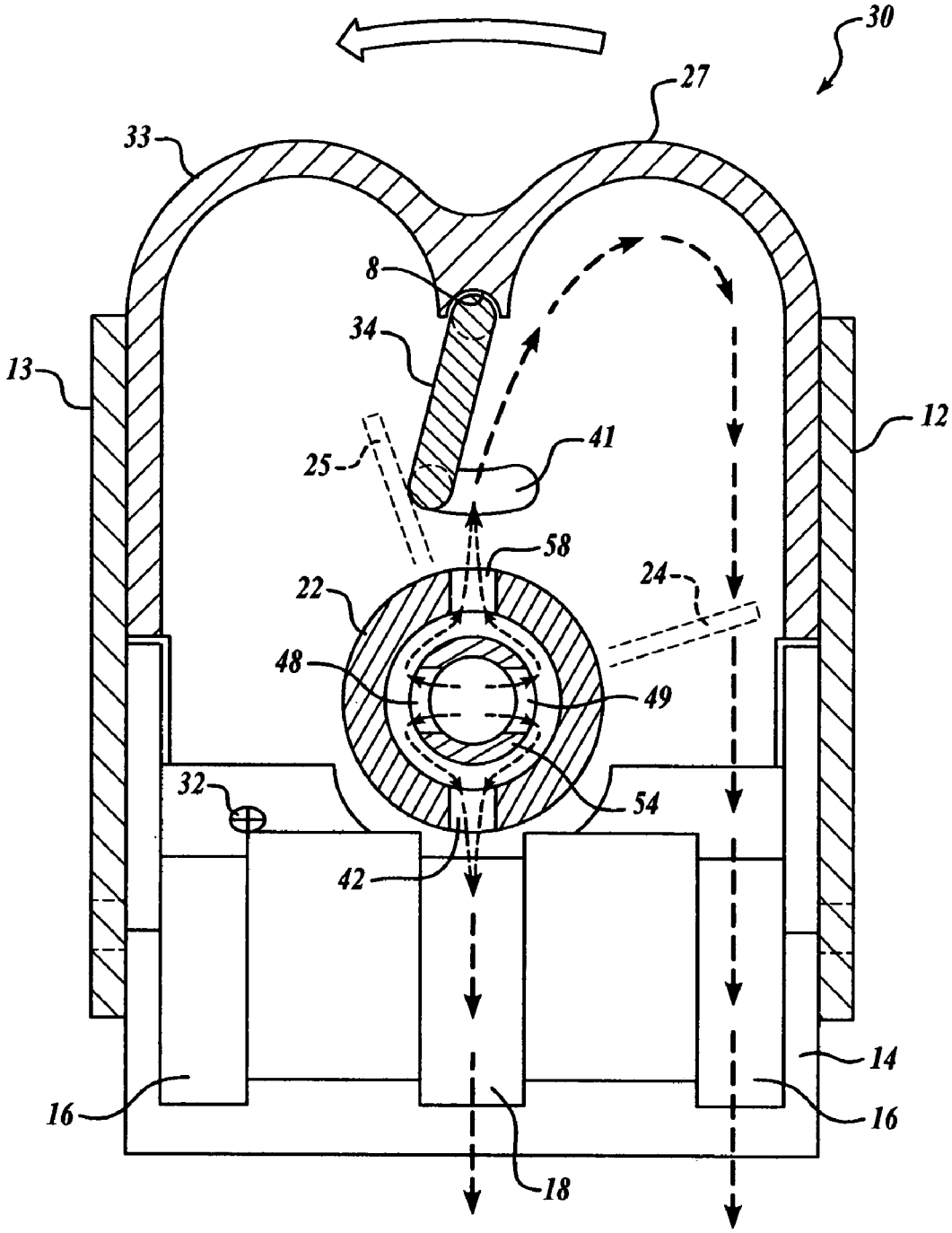
FIG. 3A is an above cut-away view of the liquid flow pattern absent the top housing plate showing flow in the clockwise direction.

In FIG. 3A the deflector (34) rotates radially inward from the pivot arm (6), (7), and (9) as directed by the selector (36). The deflector (34) deflects the water from the posterior spray orifice (58) in one direction or the other across the curved surface.

The side housing brackets (12) and (13) are sealed and are affixed to the bottom housing plate (43) on the bottom edge. On the anterior end of the bottom housing plate (43), the double curved surface (31) is attached. The top housing plate (4) having a pivot arm hole (6) and a top housing plate coupler aperture (3) is affixed to the top edges of the double curved surface (31) and the side-housing bracket (12) and (13). The top end of the pivot arm (6) extends up through the pivot arm-hole (28) with adequate tolerance to permit free rotation in the top housing plate (4) and the spray coupler (22) also extends up through the top housing plate (4) where the housing cap (2) is affixed to the spray coupler (22). The journal assembly (52) extends up through the spray coupler (22), through the top housing plate coupler aperture (3) and the entire sprinkler is held in place by a coupler cap (2) that has a water-tight seal to prevent water from escaping from the top of the journal assembly (52).

At the posterior ends of the side housing brackets (12) there are elevator pin holes (29) that allow the insertion of elevator pins (21) and opposite side pin (not shown). The elevator pinholes allow the elevator table (14) to be rotated to any one of a range of angles by the operator with a set screw (not shown) that is threaded into a set screw hole (32) in the housing elevator table (14). The operator can adjust the housing elevator (14) at a variety of angles with the set screw (not shown). The housing elevator (14) may be level as illustrated in FIG. 2 or the housing elevator (14) may be adjusted up to as high as approximately 45 degrees as illustrated in FIG. 1 in order to maximize the distance of the spray coverage. The side (16) and middle (18) grooves (FIG. 3A) in the elevator table allows the water droplets to be channeled or guided in a uniform pattern so that the water is collected before it is dispersed.

FIG. 3A is a downward view into the sprinkler housing (10) (FIG. 1) with the top housing plate (4) removed to illustrate a flow pattern showing a clockwise deflector position (30). Water comes up through the sprinkler shaft (54) (FIG. 2) and exits through oppositely positioned sprinkler shaft outlets (48) and (49). The water then enters the space between the sprinkler shaft (54) and the spray coupler (22). The water exits simultaneously through the posterior spray orifice (42) and the anterior spray orifice (58). The water from the anterior spray orifice (58) deflects off the deflector (34) and flows across either the clockwise curved surface (27) or the counter-clockwise curved surface (33). And, the water flows across either side of the housing bracket (12) or (13). The deflector (34) is positioned due to the movement of the sprinkler housing (10). The selector (36) hits the top angle arm adjuster (25) and is stopped in movement until the sprinkler housing (10) causes the selector (36) to hit the bottom angle adjuster (24) and stop movement and reverses water flow and head rotation direction and reverses back in the other direction. The deflector (34) operates radially inwardly from the attached pivot arm top (6). The curved surfaces (27) and (33) collect the anterior water stream and direct the collected water stream to the posterior area of the sprinkler housing (10) for exit across the elevator table (14) after collection by the side (16) and middle grooves (18). The diameter of the curved surfaces (33) and (27) is approximately 0.8 inches. However, the diameters of the curved surfaces (33) and (27) could be greatly expanded as long as the momentum of the water maintains enough force to turn the sprinkler housing, and move across the water table (14). The diameter of the curved surfaces (33) and (27) could also be contracted as long as the water in the exit path did not contact the spray coupler (22).

Figure 3B:
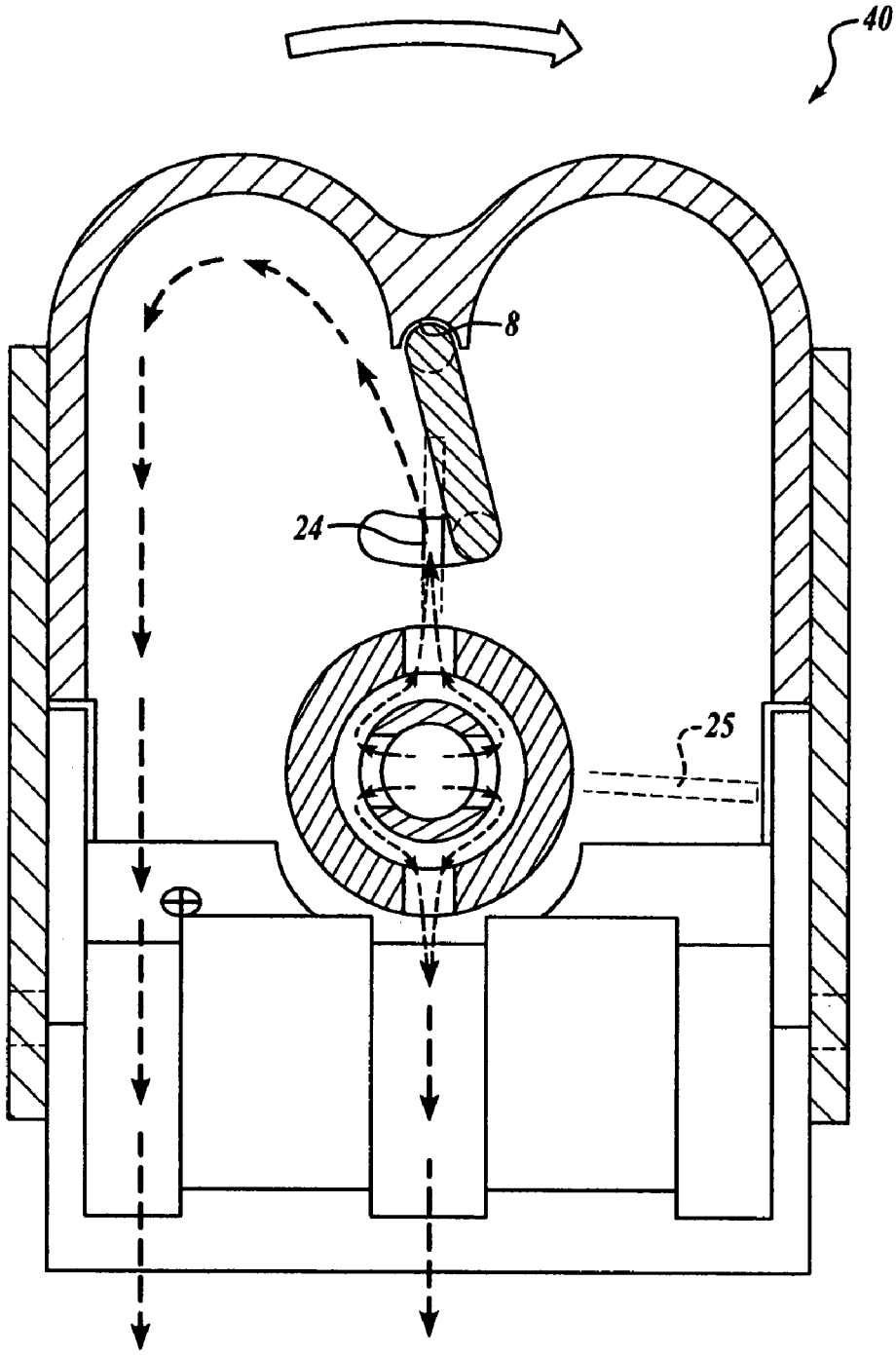
FIG. 3B is an above cut-away view of the liquid flow pattern absent the top housing plate showing flow in the counter-clockwise direction.

The water stream in turn pushes on the curved surfaces (27) and (33) to turn the sprinkler housing (10) in the opposite direction. FIG. 3A illustrates the water directed in a clockwise direction (30) and the sprinkler housing (10) moving in a counter-clockwise direction, which would force the sprinkler head to move in a counter-clockwise direction (40) (FIG. 3B). As illustrated in FIG. 3B the selector (36) (FIG. 2) has h:t the bottom angle adjuster arm (24) and is deflecting water in the counter-clockwise direction (40) where it will remain until the sprinkler housing (10) moves the selector (36) back to the top angle adjuster (25).

Figure 4A:
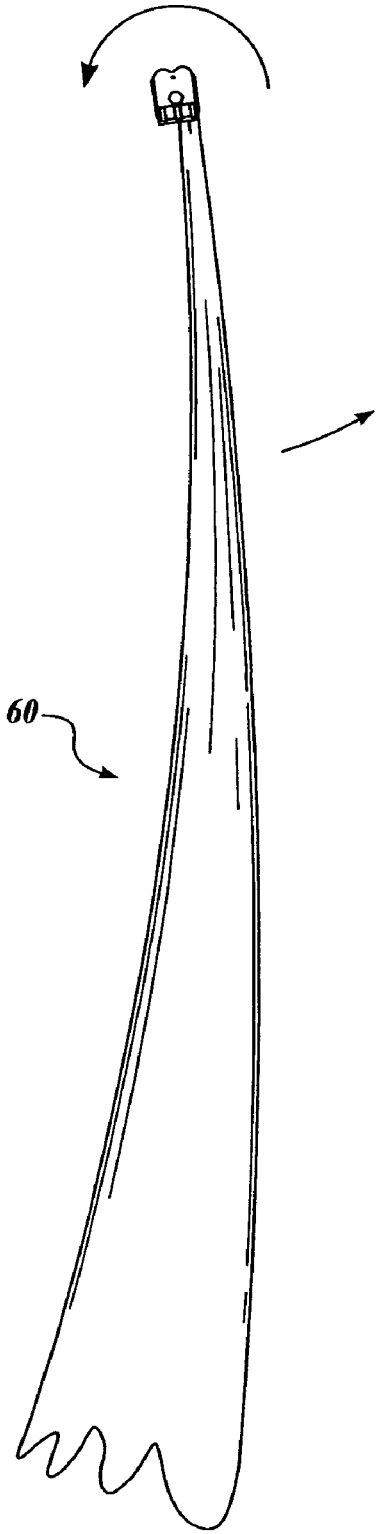
FIG. 4A shows the spray pattern in the clockwise direction.
Figure 4B:
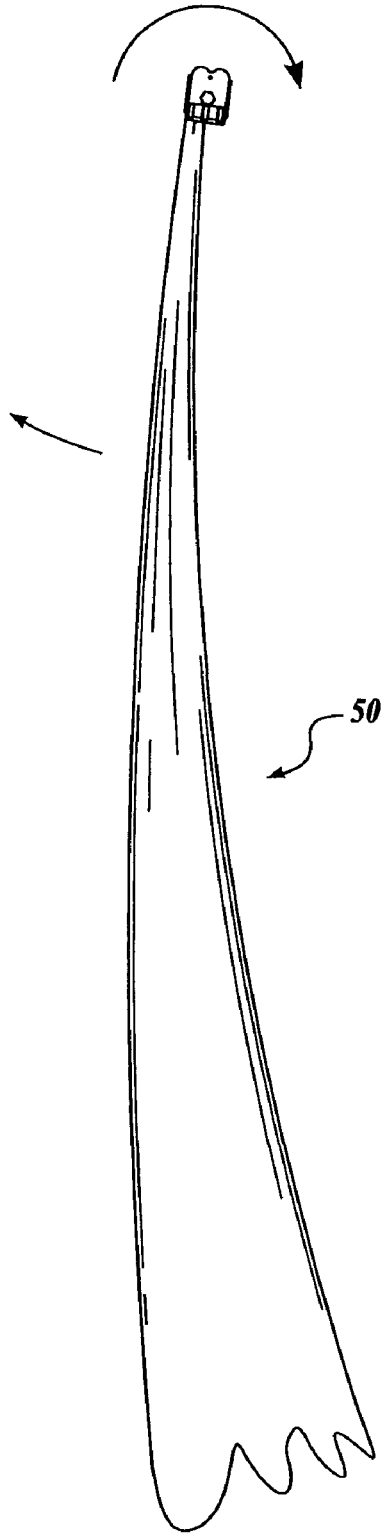
FIG. 4B shows the spray pattern in the counter-clockwise direction.

FIG. 4A illustrates the clockwise spray pattern (60). FIG. 4B illustrates the counter-clockwise spray pattern (50).

Figure 5:
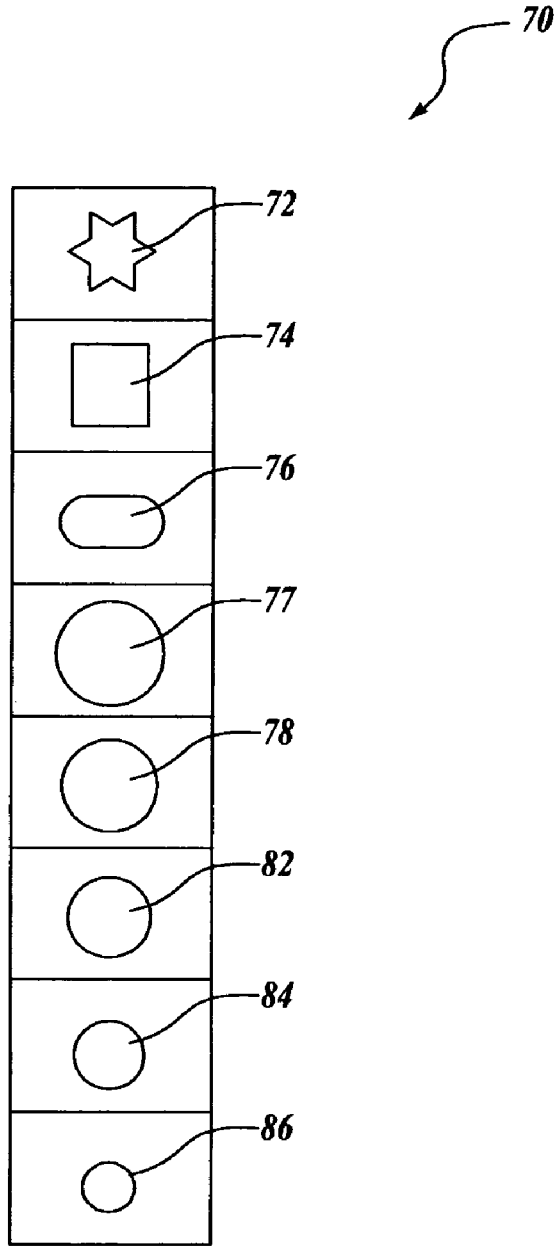
FIG. 5 represents the different size orifices that can be used in the coupler head.

FIG. 5 illustrates the different shapes and sizes of orifices that can be used in the coupler head to project water at different flow rates (70). These orifices may be cut as holes or shaped in the form of a nozzle that attaches into the coupler head and protrudes over the bottom housing plate (43). The different shapes are star (72), square (74), oblong (76), and then different sizes of circles (77), (78), (82), (84), and (85).

Figure 6:
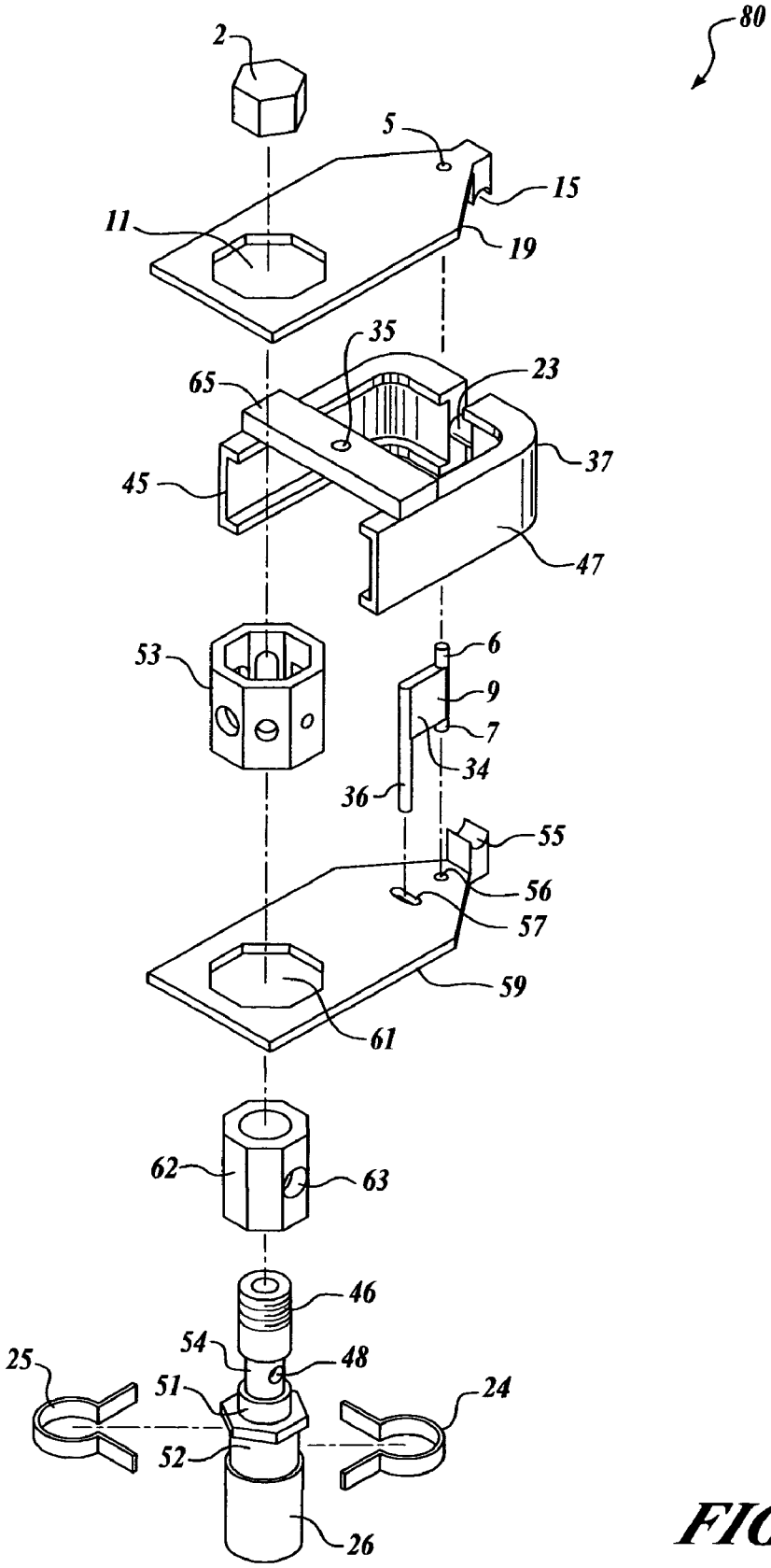
FIG. 6 represents an exploded view grooved housing side brackets and a grooved double-curved surface.

FIG. 6 illustrates a second embodiment (80) of the present invention that is designed with a grooved side brackets (45) and (47). A lock one (15) and key (25) mechanism attaches the top rectangular housing bracket (19) having an octagon orifice (11) to a unified grooved side housing bracket (45), side (37) front and (47) side. The unified housing bracket is braced with a flat plane (65) with a flat plane orifice (35). The octagon spray coupler sleeve (53) fits into the octagon-orifice (11). The bottom rectangular housing plate (59) fits into the grooved side housing bracket (45) side, (37) front and (47) side with a lock two (55). The bottom rectangular housing plate (59) has a pivot arm orifice (56) and a selector orifice (59). The octagon spray coupler (62) has an octagon spray coupler (62) with an octagon selector coupler orifice (63).

We claim:

1. A double curved surface deflector sprinkler, comprising:

a liquid dispenser with a posterior orifice and an anterior orifice that simultaneously disperse the liquid and provide torque on a sprinkler head;

a selector;

a deflector;

a pivot arm; and a double curved surface with an inner midpoint pivot arm slot having a clockwise directing curved surface and a counter-clockwise curved surface, wherein a liquid is dispensed from the dispenser across the deflector, a selected direction over a selected curved surface, to provide a spray of liquid.

2. The sprinkler according to claim 1, wherein the selector is attached to the deflector and the deflector is attached to the pivot arm reversibly directed by a top angle arm adjustor and a bottom angle arm adjuster, the deflector is adjustably positioned radially inward from the double curved surface inner midpoint pivot arm slot to direct the stream of water.

3. The sprinkler according to claim 2, wherein an adjustable elevator lifts the spray of liquid to a higher elevation to increase a coverage area.

4. The sprinkler according to claim 3, wherein the elevator has a middle groove and two side grooves.

5. The sprinkler according to claim 1, wherein the liquid dispenser has two frictionally reducing bearing seal surfaces.

6. A sprinkler, comprising:

a pipe connector;

a journal assembly attached to the pipe connector;

a sprinkler shaft with two opposite holes, the sprinkler shaft with two opposing holes inserted into a bottom coupler bearing with frictional reducing surfaces and a top coupler bearing with two opposing holes and with frictional reducing surfaces;

a spray coupler having an anterior spray orifice and a posterior spray orifice, inserted over the bottom coupler bearing with frictional reducing surfaces;

the spray coupler inserted into a bottom housing plate having a spray coupler hole, a selector slot and a pivot arm hole;

a deflector assembly attached to a selector and a pivot arm, the selector extending down through the selector slot between the arms of a top angle adjuster and the arms of a bottom angle adjuster, the top and bottom angle adjusters attached to the journal assembly, the pivot arm extending into the pivot arm hole;

the spray coupler and the deflector assembly encased with two-side housing brackets having upper edges and lower edges attached to a double curved surface with a top edge and a bottom edge, the side housing brackets having elevator pivot holes, the bottom housing plate affixed to the bottom edge of the side housing brackets and the bottom edge of the double curved surface; and a top housing plate having a spray coupler hole and a pivot arm hole, the housing plate attached to the upper edge of the side housing brackets and the upper edge of the double curved surface.

7. A method of sprinkling water onto a surface, comprising:

moving a stream of water through a series of friction reducing bearings;

directing the water stream with a selector attached to a deflector positioned radially inward from a pivot arm;

curving the directed water stream over a curved surface in a clockwise or counter-clockwise direction as directed by the selector;

gathering the directed water stream with a middle and two outside grooves in an elevator table; and elevating the gathered stream of water with the elevator table by elevating the table to a desired angle with a set screw.

* * * * *